US005597446A

United States Patent [19]

Sato et al.

[11] Patent Number: 5,597,446

[45] Date of Patent: Jan. 28, 1997

[54] METHOD OF CONTROLLING A POSITION OF ROTOR IN A HIGH PRESSURE FEEDER

[75] Inventors: Junichiro Sato; Tadayo Ando; Sumio Hayakawa; Ryuji Ouchi, all of Kasugai, Japan

[73] Assignee: New Oji Paper Co., Ltd., Tokyo, Japan

[21] Appl. No.: 304,829

[22] Filed: Sep. 13, 1994

Related U.S. Application Data

[63] Continuation of Ser. No. 9,088, Jan. 26, 1993, abandoned.

[30] Foreign Application Priority Data

Jan. 31, 1992 [JP] Japan ..... 4-042345

[51] Int. Cl.[6] ..... D21C 7/06

[52] U.S. Cl. ..... 162/49; 162/52; 162/61

[58] Field of Search ..... 162/52, 246, 238, 162/61, 62, 49, 19, 252

[56] References Cited

U.S. PATENT DOCUMENTS 3,822,179 7/1974 Chari et al. ..... 162/52
3,898,124 8/1975 Olsen ..... 162/238
4,057,461 11/1977 Richter ..... 162/238

FOREIGN PATENT DOCUMENTS 1-239184 9/1989 Japan .

*Primary Examiner*—Steven Alvo
*Attorney, Agent, or Firm*—Armstrong, Westerman, Hattori, McLeland & Naughton

[57] ABSTRACT

In an apparatus and method for controlling the position of a rotor in a truncated conical feeder for feeding a feed comprising a lignocellulose material and an alkaline cooking liquor to a pulping digester; the position of the rotor in the feeder is detected by a rotor position detector; and a signal indicating the detected position is input to a control device; the rotor is moved at a distance of 0.03 to 0.4 mm every 0.3 to 4 days by driving an electric motor and moving a shaft of the rotor in response to a signal, when the rotor is moved a predetermined distance, and the rotor-moving motor is stopped by a signal input from the control device.

1 Claim, 1 Drawing Sheet

METHOD OF CONTROLLING A POSITION OF ROTOR IN A HIGH PRESSURE FEEDER

This application is a continuation of application Ser. No. 08/009,088 filed Jan. 26, 1993, now abandoned.

BACKGROUND OF THE INVENTION

1. Field of the Invention

The present invention relates to an apparatus and method of controlling a position of a rotor in a high pressure feeder.

More particularly, the present invention relates to an apparatus and method of controlling a position of a rotor in a truncated conical high pressure feeder to prevent wear of the rotor and reduce the exchange frequency of the rotor.

2. Description of the Related Art

A continuous digester is widely employed as an apparatus for producing pulp from a lignocellulose material by an alkaline pulping process.

A feed comprising lignocellulose material such as wood chips and an alkaline cooking liquor is fed into the pulping digester through a high pressure feeder, usually a truncated conical rotary feeder.

The high pressure feeder serves to feed the lignocellulose material (wood chips) together with the alkaline cooking liquor to the continuous digester, and to seal the continuous digester from the ambient atmosphere so as to maintain the pressure in the continuous digester at a high level. Accordingly, to maintain a high pressure in the continuous digester, a tight seal between the casing of the high pressure feeder and the rotor in the feeder is very important.

Usually, the high pressure feeder comprises a truncated conical rotor, a casing receiving the rotor therein, and an electric motor for driving the rotor. This rotor-driving motor is arranged at a small diameter end side of the rotor and close to a rotating shaft of the rotor.

During the movements of the rotor shaft in the high pressure feeder, the rotor moves in the direction of the small diameter end thereof by pushing the rotor shaft inward, and in the direction of the large diameter end thereof by pulling the rotor shaft outward.

During the feeding operation, the outside surface of the rotor of the high pressure feeder is worn away. The main reasons for the wear reside in the rotation of the rotor producing friction between the outside surface of the rotor and the inside surface of the casing, and the unavoidable sticking of the lignocellulose material (wood chips) containing foreign substances such as sand or metallic pieces into the space between the rotor and the casing.

Due to the wear of the outside surface of the rotor by friction produced between the rotor and the casing, and sticking of foreign substances into the space between the rotor and the casing, the clearance between the rotor and the casing is gradually enlarged.

When the clearance is enlarged, it becomes impossible to completely seal the high pressure feeder and thus the continuous pulping digester cannot be smoothly operated. Accordingly, to adjust the clearance to an appropriate level, the rotor is moved by pushing the rotor shaft inward.

As mentioned above, to stably operate the continuous pulping digester, it is indispensable to maintain an appropriate clearance between the rotor and the casing by pushing the rotor shaft inward. In a conventional operation, the pushing operation of the rotary shaft is carried out manually in accordance with the experience of the operator. However, since the clearance is very small, it is difficult to carry out the pushing operation of the rotor shaft and accurately adjust the clearance. Therefore, the pushing operation of the rotary shaft is often inappropriately carried out and the inside surface of the casing and the outside surface of the rotor are undesirably worn by excessive pushing of the rotor shaft or by allowing the sticking of foreign substances into the space between the casing and the rotor.

Japanese Unexamined Patent Publication (JP-B-) No. 1-239,184 discloses an apparatus and a method of automatically controlling an electric motor for moving a truncated conical rotor in response to a change in the load torque of the motor, thereby reducing the wear rate of the rotor.

The inventors of the present invention studied the wear of the rotor, the types of foreign substances in the lignocellulose material (wood chips), and the change in the amount of foreign substances with time.

Namely, the inventors extracted the foreign substances from wood chips by using a foreign substance-separator having a sand trap and a metal trap, and measured the weight of the collected foreign substance, at time intervals of 4 hours over a period of 30 days. From this study it was found that the amount of foreign substances contained in the wood chips varied in a range of from 1.2 kg to 54.4 kg per 4 hours.

Also, the inventors found that when a mixture of various cargoes of wood chips collected from various regions was supplied to a continuous pulping digester, and the mixing proportions of the various cargoes of wood chips were constant, the content of the foreign substances in the mixed wood chips was substantially constant.

Further, the inventors found that when the content of the foreign substances in the mixed wood chips was constant, the wearing rate of the rotor in the high pressure feeder was substantially constant, even if the operational conditions of .the high pressure feeder, for example, the number of revolutions of the rotor and the feeding rate of the wood chips (absolute dry weight/day) varied.

Furthermore, the inventors of the present invention found that in the operation of the continuous pulping digester, a change in the number of revolutions of the rotor frequently causes a change in the feeding rate of the wood chips, which corresponds to the production rate of the pulp by the digester, and a change in the flow rate of an alkaline cooking liquor supplied under pressure to the high pressure feeder causes the load torque of the rotor-driving electric motor to vary, and therefore, if the rotor shaft-pushing operation is controlled in response to a change in the load torque of the rotor-driving electric motor, the rotor shaft was sometimes automatically pushed or pulled even when it was unnecessary. Accordingly, the above-mentioned controlling method and apparatus, in which the rotor shaft-pushing operation is controlled in response to a change in the load torque of the rotor-driving motor, were not expected to reduce the wear rate of the rotor and thus it is difficult to affirm that this technique is useful from a practical point of view.

Under these circumstances, there is a strong demand to provide a new control apparatus and method for the rotor in the truncated conical high pressure feeder, that appropriately reduces the wear rate of the rotor.

SUMMARY OF THE INVENTION

An object of the present invention is to provide an apparatus and method of controlling a position of a rotor in a truncated conical feeder for feeding a feed comprising a lignocellulose material and an alkaline cooking liquor to a pulping digester, which effectively maintain an appropriate clearance between the rotor and a casing for the rotor and prevent the rotor from wearing.

The above-mentioned object can be attained by the apparatus of the present invention, which comprises a detector for detecting a position of a rotor and a control device in which a signal showing information concerning the position of the rotor is input from the detector and a signal responding to the information from the detector is output to an electric motor for pushing inward and pulling outward a shaft of the rotor, thereby adjusting the position of the rotor.

Also, the above-mentioned object can be accomplished by the method of the present invention using the apparatus as mentioned above, which comprises detecting the position of the rotor, and adjusting the position of the rotor in response to the detecting results by pushing inward a shaft of the rotor at a rate of 0.03 to 0.4 mm every 0.3 to 4 days.

DESCRIPTION OF THE PREFERRED EMBODIMENTS

Figure 1:
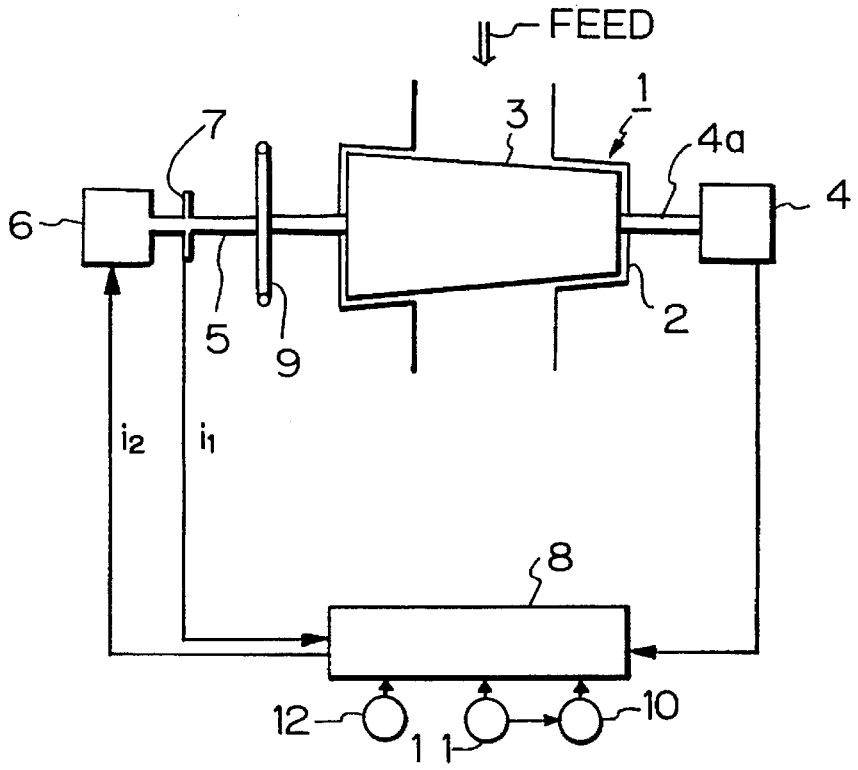
FIG. 1 explains the constitution of an embodiment of an apparatus of the present invention.

An embodiment of the apparatus of the present invention is shown in FIG. 1.

In FIG. 1, a truncated conical high pressure feeder 1 comprises a casing 2, a rotor 3, and an electric motor 4 for driving the rotor 3 (for example, rated current: 95 A, rated output: 55 KW). The rotor 3 rotates, for example, at a minimum of 5 rpm and a maximum of 12 rpm. The electric motor 4 is connected to a small diameter end of the rotor 3 through a revolution shaft 4*a*.

At a large diameter end side of the high pressure feeder 1, an electric motor 6 is connected to a large diameter end of the rotor 3 through a shaft 5. The rotor 3 is pushed or pulled by driving the motor 6 through the shaft 5. The shaft 5 is referred to as a pushing shaft hereinafter. Also, the motor 6 is referred to as a pushing motor hereinafter.

The pushing motor 6 is, for example, a harmonic drive type electric motor (1.5 KW×4P×1/258).

In FIG. 1, a detector 7 for detecting the position of the rotor 3 is attached to the pushing shaft 5, and a control device 8 is electrically connected to the detector 7 and the pushing motor 6. Also, a handle 9 is attached to the pushing shaft 5, to push or pull the pushing shaft manually.

In FIG. 1, the control device 8 is attached with a timer 10, a computer 11 for determining the wood chip blending rate and an indicator 12 for indicating the position of the rotor 3.

Time intervals, at which the pushing motor 6 is driven, are set by the timer 10. The timer 10 outputs a signal for starting a driving operation of the pushing motor 6, to the control device 8, and the control device 8 then outputs a signal in response to a signal from the timer 10 to the pushing motor 6 to drive the pushing motor 6. By driving the pushing motor 6, the pushing shaft 5 revolves and pushes the rotor 3 in a direction toward the small diameter end of the rotor 3.

The pushing distance of the rotor 3 is detected by the rotor position detector 7, and a signal $i_1$ in response to the detecting results is output from the detector 7 to the control device 8. When the control device 8 has confirmed that the pushing distance of the rotor 3 conforms to a predetermined value, a signal i2 for stopping the pushing motor 6 is output from the control device 8 to the pushing motor 6.

The load current of the rotor-driving motor 4 is always checked by the control device 8. When the load current comes outside of a predetermined range, particularly in the range of from 30% to 50% of the rated current (when the rated current is 95 A, in the range of from 28.5 to 48.5 A), the control device 8 controls the pushing motor 6 so as to push or pull the rotor 3 at a distance of 0.05 mm per control operation.

The wood chip blending rate-computer 11 computes a blending rate of the wood chips from the number of revolutions of a chip-discharging screw of each chip silo and outputs signals concerning the pushing distance of the rotor and the time intervals of the rotor-pushing operations, in response to the computing results, to the control device 8 and the timer 10, respectively.

The control device 8 and the timer 10 are provided with an outside input device (not shown in FIG. 1) for the input of signals concerning the pushing distance of the rotor 3 through the shaft 5 and the pushing operation time intervals from the outside.

The rotor position detector usable for the present invention must be able to detect the location (position) of the rotor with an accuracy of ±0.01 mm or less. If the accuracy is more than ±0.01 mm, there is a possibility that the rotor shaft will be excessively or insufficiently pushed and thus disadvantageously promoting wear of the rotor. Therefore, the position of the rotor should be detected with a very high degree of precision.

In the method of the present invention, the frequency of the pushing operation on the rotor shaft in the high pressure feeder must be once every 0.3 to 4 days, preferably 0.5 to 2 days. If the frequency is less than once every 4 days, the clearance between the rotor and the casing could be, sometimes, unduly enlarged. Also if the frequency is more than once every 0.3 days, the pushing distance in each pushing operation becomes too small and thus it becomes very difficult for the pushing operation to control the pushing distance with any degree of accuracy.

In the method of the present invention, the pushing distance in each pushing operation is in the range of from 0.03 to 0.4 mm.

When the pushing distance is less than 0.03 mm, the rotor position detector must have an extremely high degree of detecting accuracy, which results in the detector having a complex constitution and an enlarged scale. This complex and enlarged detector is not appropriate for practical use. Also, there is the possibility that the distance pushed will be unsatisfactorily small.

When the pushing distance is more than 0.4 mm, it is too large for one pushing operation and thus there is the possibility that the distance pushed will be excessive, thereby promoting wear of the rotor.

In the present invention, it is preferable that the load current (ampere) of the rotor-driving electric motor in the high pressure feeder be in the range of from 35% to 50% of the rated current (ampere) of the electric motor. When the load current of the electric motor is within the above-mentioned range, the clearance between the rotor and the casing is most appropriate and thus wear rate of the rotor is minimized, and when the load current is clearly outside of the above-mentioned range, it is preferable that the control device be provided with means for automatically pushing or pulling the rotor shaft with a distance of about 0.05 mm.

In the apparatus of the present invention, the control device is preferably provided with an indicator for indicating a position of the rotor (which indicates an integrated value of the pushing and pulling distances in mm). In this indicator, the original position of the rotor is represented by zero "0", and a distance (in mm) between the original position and the present position of the rotor can be indicated. Accordingly, when the indicator shows that the clearance between the rotor and the casing is zero, the pushing operation of the rotor shaft is inhibited and damage to the high pressure feeder due to the pushing of the rotor can be prevented.

Where various types of wood chips that are different with respect to the cargo and the type of wood are stored separately in a plurality of chip silos and fed to the high pressure feeder from the silos, it is preferable that the apparatus of the present invention be provided with a device by which a mixing ratio of the different wood chip is automatically detected, and the frequency of the rotor shaft-pushing operation and the pushing rate of the rotor shaft are automatically adjusted in response to the detected mixing ratio.

Usually, the continuous pulping digester may be provided with a low or high pressure feeder consisting of a truncated conical rotary feeder. The control apparatus and method of the present invention can be applied to the low or high pressure feeder.

Figure 2:
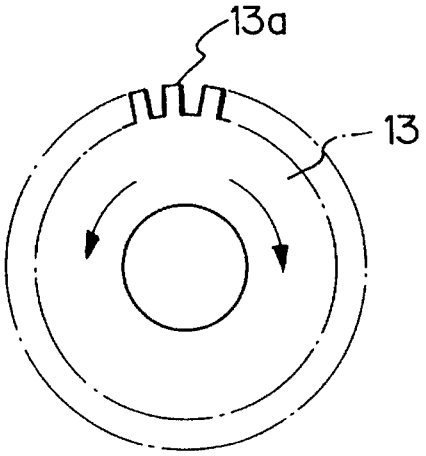
FIG. 2 is an explanatory front view of an embodiment of a metal circular disc in a rotor position detector usable for the present invention.
Figure 3:
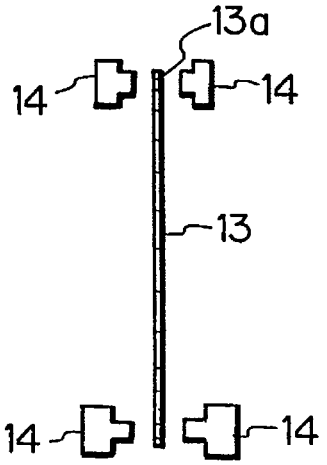
FIG. 3 is an explanatory side view of the rotor position detector as shown in FIG. 2.

FIGS. 2 and 3 show a front view and a side view of an embodiment of the metal disc of a rotor position detector usable for the present invention, respectively.

Referring to FIGS. 2 and 3, a metal circular disc 13 having a diameter of, for example, 1,000 mm is provided with 72 teeth 13 a located in a circular edge portion thereof at angular intervals of 5 degrees. The teeth 13*a* have a height of 10 mm.

As shown in FIG. 3, two pairs of close relays 14 are arranged in such a manner that the teeth 13*a* of the metal disc 13 are interposed between each pair of the close relays 14.

When the rotor shaft-pushing motor 6 revolves and pushes inward or pulls outward the rotor 3, the number of pulse signals output from the proximity switches 14 are integrated by the control device. The pushing or pulling distance (mm) of the rotor is calculated from the integrated value of the pulse signals by the control device.

After the pushing motor is driven, when one pair of proximity switches 14 output a signal "ON" and the other pair of proximity switches 14 output a signal "OFF", the rotor shaft is pushed inward. Also, when both pairs of proximity switches 14 output a signal "ON", the rotor shaft is pulled outward.

The detecting error of the rotor position detector 7 is preferably in the range of ±0.005 mm.

EXAMPLES

The present invention will be further explained by the following examples.

Examples 1 to 3 and Comparative Examples 1 and 2

In each of the Examples 1 to 3, a continuous pulping digester was continuously operated for 20 days without changing the blending proportions of the wood chips. The production rate of the soft wood pulp (NUKP) in an bone dry weight was changed within a range of 600 to 750 tons/day.

The number of changes was 38 times/20 days, which was the same as in a usual operation of the continuous pulping digester.

In Example 1, the rotor shaft of the high pressure feeder was pushed at a pushing rate of 0.05 mm every 0.5 days.

In Example 2, the pushing rate of the rotor shaft was 0.3 mm every 3 days.

In Example 3, the pushing rate of the rotor shaft in the high pressure feeder was 0.15 mm every one day.

In Comparative Example 1, the pushing and pulling operations of the rotor shaft in the high pressure feeder was carried out manually by a controlling operator.

In Comparative Example 2, a variation in the wave form of the load torque of the rotor-driving electric motor 4 was detected, and the pushing and pulling operation was carried out in response to the results of the above-mentioned detection, in accordance with the method of JP-B-1-239,184.

In each of the Examples 1 to 3 and Comparative Examples 1 and 2, an average ampere of the rotor-driving electric motor which had a rated ampere of 95 amperes, the number of occurrences of overloading on the motor, and the pushing distances of the rotor shaft were recorded. The results are shown in Table 1.

It was confirmed from the operational data of the continuous pulping digester over the past ten years that when the average ampere of the rotor-driving electric motor was in the range of from 33 to 42 amperes, which corresponds to 35% to 44% of the rated ampere of 95 amperes of the motor, the rotor had a small wearing rate.

TABLE 1

| | Example 1 | | | | |
|---|---|---|---|---|---|
| | Example | | | Comparative Example | |
| Item | 1 | 2 | 3 | 1 | 2 |
| Average ampere of rotor-driving electric motor (*)1 | 37 | 35 | 39 | 49 | 44 |
| Number of overloadings (time/20 days) | 0 | 0 | 0 | 4 | 0 |
| Pushing distance (mm/20 days) | 1.89 | 1.98 | 2.30 | 4.04 | 3.81 |

Note:
(*)1 . . . The rate current of 95 amperes

Table 1 shows that when the pushing operation of the rotor shaft was controlled in accordance with the present invention, the wear of the rotor was reduced.

The apparatus and method of the present invention can effectively control the pushing and pulling operations of the rotor shaft in the high pressure feeder and can reduce the wear rate of the rotor. Accordingly, the frequency of the exchange operation of the rotor due to the wear rate thereof can be significantly reduced and control thereof can be easily attained in response to a change in the amount of foreign substances stuck into the space between the rotor and the casing, by the apparatus and method of the present invention.

We claim:

1. A method of controlling a position of a rotor having smaller and larger diameter end sides in a truncated conical feeder for feeding a feed comprising a lignocellulosic material and an alkaline cooking liquor to a pulping digester, comprising:

rotating the rotor for feeding said feed;

detecting a position of the rotor by a detector with an accuracy of +0.01 mm or less; and adjusting the position of the rotor by inputting a signal, showing information concerning the position of the rotor from the detector to a control device, and then by outputting a signal, responding to the information signal from the detector, from the control device to an electric motor to push in the direction of the smaller diameter end side of the rotor, or pull in the direction of the larger diameter end side of the rotor, the shaft of the rotor the pushing or pulling of the rotor shaft being carried out at a rate of 0.03 to 0.4 mm every 0.3 to 4 days.

* * * * *